United States Patent [19]

Serber

[11] 4,405,299

[45] Sep. 20, 1983

[54] BURNER IGNITION AND FLAME MONITORING SYSTEM

[75] Inventor: Stephen L. Serber, New Hope, Minn.

[73] Assignee: Honeywell Inc., Minneapolis, Minn.

[21] Appl. No.: 286,500

[22] Filed: Jul. 24, 1981

[51] Int. Cl.[3] ..... F23N 5/00

[52] U.S. Cl. ..... 431/78; 431/25

[58] Field of Search ..... 431/25, 59, 74, 78

[56] References Cited

U.S. PATENT DOCUMENTS 3,385,648 5/1968 Quinn ..... 431/59
3,454,345 7/1969 Dyre .
3,551,084 12/1970 Willson .
3,594,107 7/1971 Willson et al. .
3,619,096 11/1971 Krueger et al. .
3,826,605 7/1974 Hantack .
4,056,348 11/1977 Wolfe .
4,188,181 2/1980 Rippelmeyer et al. .
4,298,335 11/1981 Riordan et al. ..... 431/25

*Primary Examiner*—Carroll B. Dority, Jr.
*Attorney, Agent, or Firm*—Alfred N. Feldman

[57] ABSTRACT

A fuel burner ignition system using a hot surface ignitor means as both an ignition element and as one element of a flame rectification sensor. The hot surface ignitor means ignites fuel issuing from a fuel burner, and also acts as the flame rod or sensing means of a flame detecting system.

10 Claims, 2 Drawing Figures

BURNER IGNITION AND FLAME MONITORING SYSTEM

CROSS-REFERENCE TO OTHER APPLICATIONS

The present invention has subject matter which relates to the same technology as a pending application Ser. No. 282,566 filed in the names of J. E. Bohan and B. J. Hinton on July 13, 1981 entitled Interrupted Power Hot Wire Gas Ignition Control System which is assigned to the assignee of the present invention.

BACKGROUND OF THE INVENTION

In recent years, due to the accelerating cost of fuels, it has become desirable to replace the conventional standing pilot used in gas furnaces with an interrupted type of ignition system. In the past the standing pilot has been the primary ignition source for gas furnaces. The standing pilot was very reliable and was very inexpensive to manufacture. In the days when gaseous fuels were relatively cheap, the continuously ignited standing pilot used an insignificant amount of fuel, from a cost standpoint. In recent years the shortage of fuels and the acceleration of their cost has made the standing pilot undesirable in certain types of applications. In addition, a number of states have legislated that installation of fuel burning equipment can no longer include a standing pilot in order to conserve fuels. This change in the status of the standing pilot has dictated that the standing pilot be replaced with some other type of ignition source.

The most common ignition source to replace the standing pilot has been a spark ignition source that typically uses a silicon controlled rectifier as the heart of a relaxation oscillator for the generation of an ignition spark. While this type of equipment is generally reliable, and only moderately more expensive than other approaches, it has the drawback of generating both audible and radio frequency noises. The constant arcing of a spark for generation of a flame at the pilot is objectionable. At the same time this arcing causes the generation of radio frequency noises that are transmitted in the normal power lines of a home and cause interference with other types of electrical equipment. For these reasons, the spark ignition systems that are replacing the standing pilot systems have deficiencies which make them of limited value.

An attempt has been made to provide other types of ignition systems for burners to replace the spark type of ignition systems. The most common replacement for the spark ignition system is a hot surface ignition system wherein an ignition element made of a high resistance metal or of a high resistance ceramic is used. The high resistance element is energized from a source of potential and will glow or be raised to an ignition temperature for the fuel being used. The drawback of this type of a system is that the hot surface ignitors have a relatively short life when used as an ignition element if kept constantly energized. As such, it has become necessary to provide a short energizing period for the hot surface ignitor, and then a means separate therefrom to monitor the existence of a flame, once one has been established.

In the earlier cross-referenced application which is assigned to the assignee of the present application, a system for energizing a hot surface ignitor and then monitoring the flame by a separate flame detection arrangement is disclosed. This arrangement has certain drawbacks in that a separate flame detection device is required in addition to the ignitor itself.

DESCRIPTION OF THE PRESENT INVENTION

The present invention is directed to a hot surface ignitor type of system in which the hot surface ignitor has a dual function. The hot surface ignitor is first used as an ignitor element, and then is deenergized. It is also placed in a flame detection circuit as the flame rod or sensing means of a flame rectification system. In this mode of operation, the ignitor is not only energized to create the pilot flame, but is also used as a sensing or flame rod element in the detection system. This allows for the simplification of the system wherein the same hot surface ignitor provides the function of igniting the fuel, and the function of becoming part of the flame rectification system to sense the existence of the flame at the burner.

DESCRIPTION OF THE PREFERRED EMBODIMENT

Figure 1:
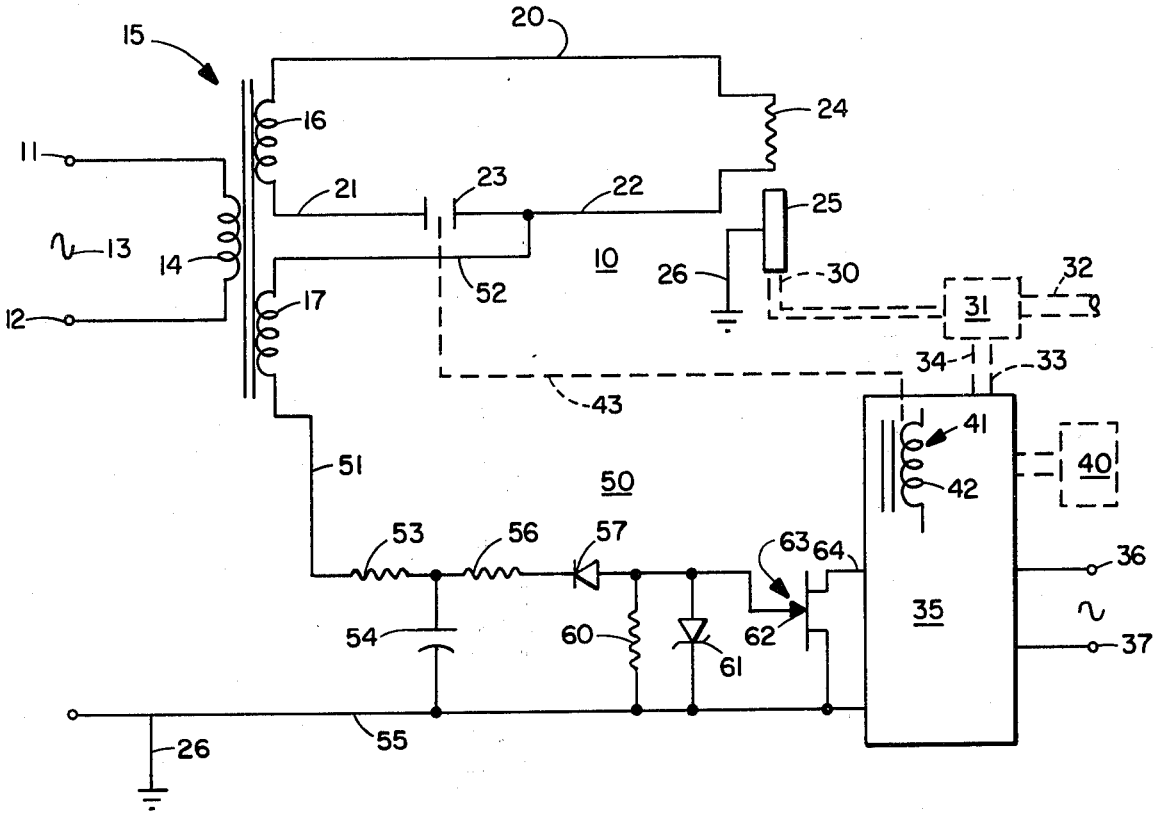
FIG. 1 is a schematic diagram of a complete burner ignition and flame monitoring system.

A complete burner ignition and flame monitoring system is generally disclosed at 10. This system is energized at a pair of terminals 11 and 12 by an alternating current indicated at 13 which supplies power to a primary winding 14 of a transformer generally disclosed at 15. The transformer 15 has two secondary windings 16 and 17. The secondary winding 16 forms a first power source means for the system. The power source means 16 is connected by conductors 20, 21, and 22 in a series circuit including an ignition control switch 23 and a hot surface ignitor means 24. The hot surface ignitor means 24 can be any type of hot surface ignitor such as a Nichrome wire or a ceramic resistor having a negative temperature coefficient. Both of these types of hot surface ignitors are well known in the electric ignition art. It will be noted that when the ignitor control switch 23 is closed that a series circuit is created from the first power source means 16 via the conductors 20, 21, and 22 to include the hot surface ignitor means 24. This allows the hot surface ignitor means to be energized and when properly energized will heat to a fuel ignition temperature for the system.

The hot surface ignitor means 24 is placed adjacent a fuel burner 25 which is grounded at 26. The fuel burner 25 typically would be the pilot burner of a gas furnace and the fuel would typically be natural or liquid petroleum vaporized gas. The present invention is not limited to this type of a fuel burner structure, but is most typically applicable to this type of structure. The fuel burner 25 would be connected by pipe 30 to a valve 31 that in turn is connected to piping 32 that is the source of fuel to the burner 25. The valve 31 is connected by conductors 33 and 34 to a primary control means generally disclosed at 35. The primary control means 35 is energized at terminals 36 and 37 from a convenient source of alternating current potential and in turn is controlled by a condition responsive means 40. The condition responsive means 40 typically would be a thermostat in a residential gas furnace installation. The primary control means 35 includes within it a switch control means generally disclosed at 41. The switch control means 41 includes a relay 42 which is mechanically linked at 43 to the ignitor control switch 23.

The burner ignition and flame monitoring system 10 is completed by a flame sensing circuit means 50 that is powered by way of a conductor 51 connected to an alternating current power source means or secondary winding 17 of the transformer 15. The alternating current power source means 17 is connected by a conductor 52 to the conductor 22 that is common with the ignitor control switch 23. The conductor 51, which supplies power from the alternating current power source means 17 to the flame sensing circuit means 50, supplies an alternating current potential to a resistor 53 that is coupled to ground by a capacitor 54. The ground is at the conductor 55 and is a common ground to the ground 26 of the burner 25. The flame sensing circuit means 50 further has a resistor 56 that is connected through a diode 57 to a further resistor 60. The output of the voltage across the resistor 60 is clipped by a zener diode 61 that is connected to a gate 62 of a field effect transistor that is generally disclosed at 63. The source-drain connections of the field effect transistor 63 are connected between the ground 55 and an input point 64 to the primary control means 35. The flame sensing circuit means 50 is a solid state flame rectification type of flame sensing circuit means.

The function of a flame rectification type of sensor is well known in the art. When a flame exists with an alternating current potential impressed across it, the flame acts to conduct more current in one direction if the polarity of the alternating current than in the reverse polarity. As such, the flame creates the equivalent of a rectifier and this equivalence is used to sense the presence or absence of a flame. Flame rectification type amplifiers are well known and the present embodiment merely is an example of one arrangement that would accomplish the use of a flame rectification signal from the combined hot surface ignitior means 24 and the burner 25. The control signal between the point 64 and ground is supplied to the primary control means 35 which can be any type of solid state primary control. A number of such controls are currently marketed and they respond to a flame rectification signal. They operate a relay in response to the flame and a condition sensing means to in turn control a source of fuel.

Figure 2:
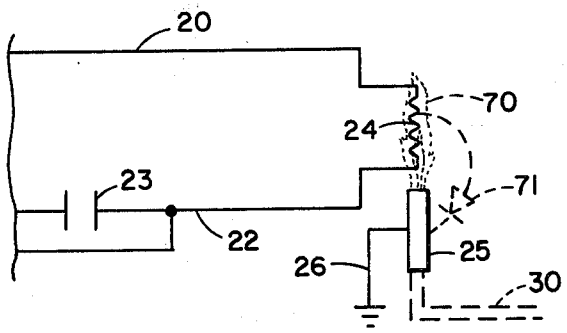
FIG. 2 is a representation of the flame rectification function when a flame exists.

In FIG. 2 the flame rectification function of the present device is pictorially displayed. In FIG. 2 a flame 70 is disclosed as existing between the hot surface ignitor means 24 and the grounded burner 25. When a potential is supplied across the conductor 22 and ground 26 of an alternating current type, a rectified current flows as is indicated by the phantom diode 71.

The disclosure of the present invention has been provided in a very elementary form wherein a simple flame rectification sensing circuit means 50 has been disclosed as controlling a primary control means 35 which responds to the condition control means or thermostat 40 to control gas to a gas valve 31 which in turn supplies gas to the burner 25 and the hot surface ignitor 24. When the condition control means 40 calls for the operation of the burner 25, the valve 31 is opened by the primary control means 35. Gas issues from the burner 25. At this same time the relay 42 is energized thereby closing the contact 23 to supply a power source 16 to the hot surface ignitor 24. The hot surface ignitor raises in temperature until an ignition point has been reached and the fuel issuing from the burner means 25 is ignited. At this same time the flame sensing circuit means 50 obtains a rectified signal across the flame 70 by means of the phantom diode 71. This rectified potential causes the field effect transistor 63 to change its state and the primary control means 35 causes the relay 42 to open circuit the contact or ignition control switch 23. This deenergizes the hot surface ignitor 24 so that it acts as a flame rod rather than as an ignition element. The removal of energizing power to the hot surface ignitor 24 allows it to have an extended life over an ignitor which was constantly energized at an ignition temperature.

The present invention has been disclosed in an elementary form wherein the hot surface ignitor 24 is used both as an ignition element and as part of a flame rectification sensor with the burner 25. A simple solid state primary control and flame sensing circuit means has been disclosed. This circuit means could be altered extensively without varying from the scope of the present invention. The present invention is defined solely by the scope of the appended claims.

The embodiments of the invention in which an exclusive property or right is claimed are defined as follows:

1. A burner ignition and flame monitoring system adapted to control a fuel burner in response to a condition responsive means, including: hot surface ignitor means adapted to be mounted in proximity to said fuel burner to ignite fuel issuing from said fuel burner; first power source means connected to said hot surface ignitor means in series circuit with an ignitor control switch to controllably energize said ignitor means to generate an ignition temperature at said ignitor means; flame sensing circuit means adapted to be connected to and operatively energized from alternating current power source means concurrently with the energization of said hot surface igniter means; said ignitor means being connected to said flame sensing circuit means with said flame sensing circuit means being responsive to the presence or absence of flame between said ignitor means and said burner by said flame effectively rectifying said alternating current power source means; primary control means connected to said flame sensing circuit means and being responsive to the presence or absence of said flame at said burner; and switch control means operated by said primary control means to in turn operate said ignitor control switch to deenergize said hot surface igniter means when flame is sensed.

2. A burner ignition and flame monitoring system as disclosed in claim 1 wherein said first and said alternating current power source means include two secondary windings of transformer means adapted to be connected to a source of alternating current potential.

3. A burner ignition and flame monitoring system as disclosed in claim 2 wherein said ignitor control switch is a relay contact; and said switch control means includes a relay which operates said relay contact.

4. A burner ignition and flame monitoring system as disclosed in claim 3 wherein said flame sensing circuit means is a flame rectification type of flame sensing circuit.

5. A burner ignition and flame monitoring system as disclosed in claim 4 wherein said hot surface ignitor means is a resistor.

6. A burner ignition and flame monitoring system as disclosed in claim 5 wherein said resistor is a negative temperature coefficient resistor.

7. A burner ignition and flame monitoring system as disclosed in claim 6 wherein said fuel issuing from said fuel burner is a gaseous fuel.

8. A burner ignition and flame monitoring system as disclosed in claim 2 wherein said flame rectification type of flame sensing circuit and said primary control means are solid state electronic circuit means.

9. A burner ignition and flame monitoring system as disclosed in claim 8 wherein said ignitor control switch is a relay contact; and said switch control means includes a relay which operates said relay contact.

10. A burner ignition and flame monitoring system as disclosed in claim 9 wherein said flame sensing circuit means is a flame rectification type of flame sensing circuit.

* * * * *